US006511629B1

(12) United States Patent
Kepplinger et al.

(10) Patent No.: US 6,511,629 B1
(45) Date of Patent: Jan. 28, 2003

(54) SHAFT FURNACE

(75) Inventors: Leopold Werner Kepplinger, Leonding (AT); Rainer Walter Kastner, Zwettl A.D.Rodl (AT); Kurt Wieder, Schwertberg (AT); Wilhelm Schiffer, Traun (AT); Wilhelm Stastny, Alberndorf (AT)

(73) Assignee: Deutsche Voest-Alpine Industrieanlagenbau GmbH (DE)

( * ) Notice: Subject to any disclaimer, the term of this patent is extended or adjusted under 35 U.S.C. 154(b) by 0 days.

(21) Appl. No.: 09/762,785

(22) PCT Filed: Jul. 12, 1999

(86) PCT No.: PCT/EP99/04875

§ 371 (c)(1),
(2), (4) Date: Apr. 11, 2001

(87) PCT Pub. No.: WO00/09765

PCT Pub. Date: Feb. 24, 2000

(30) Foreign Application Priority Data

Aug. 13, 1998 (AT) ..... 1392/98

(51) Int. Cl.[7] ..... C21B 13/02
(52) U.S. Cl. ..... 266/197; 266/199; 432/95
(58) Field of Search ..... 266/197, 198, 266/199; 432/95

(56) References Cited

U.S. PATENT DOCUMENTS

| | | | | |
|---|---|---|---|---|
| 3,816,101 A | | 6/1974 | Beggs et al. | 75/35 |
| 4,046,557 A | | 9/1977 | Beggs | 75/35 |
| 4,720,299 A | | 1/1988 | Milionis | 75/34 |
| 4,725,309 A | | 2/1988 | MacKay et al. | 75/34 |
| 5,702,246 A | * | 12/1997 | Dam | 432/95 |

FOREIGN PATENT DOCUMENTS

| | | | | |
|---|---|---|---|---|
| AT | 387037 | | 11/1988 | |
| DE | 3422185 | | 12/1985 | |
| WO | WO 99/04045 | * | 1/1999 | 266/197 |

* cited by examiner

*Primary Examiner*—Scott Kastler
(74) *Attorney, Agent, or Firm*—Ostrolenk, Faber, Gerb & Soffen, LLP

(57) ABSTRACT

The invention relates to a shaft furnace, in particular a direct-reduction shaft furnace, with a charge composed of particulate material, in particular a particulate material containing iron oxide and/or sponge iron, the said material being capable of being fed into the shaft furnace from above, and with, arranged in one plane, a multiplicity of gas-inlet orifices for a reduction gas in the region of the lower third of the shaft furnace, the shaft contour having a diametral widening and a cavity being formed between the gas-inlet orifices and the charge. The shaft furnace according to the invention makes it possible to supply gas to the shaft furnace so as to be distributed uniformly over its circumference.

14 Claims, 5 Drawing Sheets

SHAFT FURNACE

BACKGROUND OF THE INVENTION

The invention relates to a shaft furnace, in particular a direct-reduction shaft furnace, with a charge composed of particulate material, in particular particulate material containing iron oxide and/or sponge iron, the said material being capable of being fed into the shaft furnace from above, and with, arranged in one plane, a multiplicity of gas-inlet orifices for a reduction gas in the region of the lower third of the shaft furnace, the shaft furnace being surrounded externally by an annular space which is connected to the gas-inlet orifices downwards by means of gas supply ducts.

Shaft furnaces, in particular direct-reduction shaft furnaces of the type described above, are known in many forms from the prior art. Such a shaft furnace, designed essentially as a cylindrical hollow body, contains, for example, a charge composed of particulate material containing iron oxide and/or sponge iron, the material containing iron oxide being fed into the upper part of the shaft furnace. By means of a plurality of gas-inlet orifices arranged over the circumference of the shaft furnace and located in the region of the lower third of the latter, a reduction gas emanating, for example, from a melt-down gasifier is injected into the shaft furnace and consequently into the solid charge. The hot dust-laden reduction gas flows upwards through the solid charge and, at the same time, reduces the iron oxide of the charge completely or partially to sponge iron.

The completely or partially reduced iron oxide is conveyed out of the shaft furnace by means of discharge devices arranged between the bottom region of the shaft furnace and the region of the gas-inlet orifices, the charge column located in the shaft furnace sinking downwards due to gravity.

A shaft furnace must, by virtue of its design, ensure that a uniform reaction course, which is as complete as possible, and uniform sinking of the charge material can take place in it.

AT B 387,037 discloses a shaft furnace for the thermal treatment of charge materials by means of gaseous media. In this case, for the supply of reduction gas, gas-inlet orifices are provided, which are covered by an annular skirt relative to the charge materials introduced in the shaft furnace. An annular cavity is provided between the annular skirt and an annular widening of the casing of the shaft furnace, so that the reduction gas introduced can be delivered to the charge materials so as to be distributed over the circumference of the shaft furnace.

This design of the gas supply system has major disadvantages. The inner walls of shaft furnaces are conventionally lined with refractory material, for example fireclay. However, such an annular skirt cannot be produced from individual fireclay bricks, since it is connected only via its upper circumference to the casing of the shaft furnace. In principle, however, this type of gas supply system is capable of being produced monolithically, that is to say so as to be manufactured from one piece. Nevertheless, for this purpose, individual segments of the shaft-furnace casing, together with that part of the annular skirt which is suspended on the said casing, would have to be manufactured in each case from a single piece of refractory material. It is scarcely possible for this to be carried out, however, because of the size of the segments and because of their complex geometry.

Furthermore, an annular skirt produced in this way would collapse during the first loading of the shaft furnace. The lateral forces arising from charges, for example due to process-dependent increases in volume, are considerable. The annular skirt would therefore break away outwards immediately.

German Patent 34 22 185 discloses an arrangement consisting of a gasifier and of a direct-reduction shaft furnace. The direct-reduction shaft furnace has, above its bottom, screw conveyers which are arranged in a star-shaped manner and by means of which particulate material is conveyed out of the shaft furnace. The inner ends of the screw conveyers are mounted in a conical fitting in the middle of the shaft furnace. This conical fitting is connected downwards to the melt-down gasifier, so that reduction gas can flow out of the melt-down gasifier through the conical fitting into the shaft furnace. Furthermore, reduction gas is supplied to the shaft furnace via at least one gas-inlet orifice which opens into an annular space formed by an annular skirt and the shaft-furnace casing. The same applies to this annular skirt as to that in AT B 387,037, that is to say it would immediately break away laterally and/or, on account of the abrazing forces of the charge moving past it, would be ground off. This is all the more relevant as the conical fitting located at the same height as the annular skirt constitutes, from the point of view of the charge material, a reduction in the free cross section of the shaft furnace. Consequently, the laterally effective forces arising from the charge in the region of the conical fitting and of the annular skirt are also substantially higher than in other regions of the shaft furnace. Moreover, in regions of reduced cross section the charge preferentially forms baked areas, agglomerations and bridges. This prevents the charge material from sinking uniformly.

The prior art, for example U.S. Pat. Nos. 3,816,101 or 4,046,557, discloses shaft furnaces, in which a reduction gas is first introduced into a cavity which annularly surrounds the shaft furnace and from which a plurality of gas supply ducts open into a frustoconical widening of the shaft furnace casing. This annular cavity has a rectangular cross-sectional surface in vertical section, and the gas supply ducts opening into the shaft furnace lead away from the bottom and/or from the inner wall of this annular space.

This gas supply system is unsuitable when the reduction gas is to be supplied so as to be distributed uniformly over the circumference of the shaft furnace. Since the charge material rests directly against each gas-inlet orifice, the number of points for the inlet of gas into the shaft furnace and therefore into the charge is only in each case as large as the number of gas-inlet orifices.

If a dust-laden reduction gas is used, dust may settle at the mouth of the gas supply ducts into the shaft furnace and reduce the gas permeability of the charge there, with the result that further dust settles, and so on and so forth, ultimately clogging the gas supply ducts. Further dust may also be deposited on the bottom of the annular space. In an extreme situation, even particulate material from the charge may pass into the annular space. It is not possible to remove the solids which have settled in the gas supply system, without decommissioning and emptying the shaft furnace. Faults in the passage of gas through the charge, which are caused by clogged gas supply ducts, lead to an uneven reduction of the charge material and a reduction in the product quality.

SUMMARY OF THE INVENTION

The object of the invention is, therefore, to provide a shaft furnace, in particular a direct-reduction shaft furnace, the gas supply system of which is designed in such a way that the disadvantages known from the prior art are avoided.

In particular, this gas supply system is to be capable of being produced in a simple way from conventional refractory material and is to have sufficient mechanical stability relative to the laterally acting forces arising from the charge. Dust-laden reduction gas is to be capable of being distributed uniformly on the circumference of the shaft furnace and therefore, as a further consequence, also in the charge, and the clogging of gas supply channels is to be avoided.

This object is achieved, according to the invention, in that the shaft contour has a diametral widening in the region of the gas-inlet orifices and the wall of shaft furnace is designed in such a way that an annular cavity is formed between the gas-inlet orifices arranged in the region of this diametral widening and the charge.

By means of the inventive design of the gas supply system, it is possible, for the first time, to supply gas to a shaft furnace so as to be distributed uniformly over its circumference, without the need to provide a mechanically unstable annular skirt which it is scarcely possible to produce from conventional refractory bricks.

According to another advantageous feature, a number of means for dividing the annular cavity into sections separated from one another are arranged in the region of the diametral widening and are fastened to or in the wall of the shaft furnace.

Of these means for dividing the annular cavity, for example 2 to 16, but preferably 4 to 8, are arranged essentially at an approximately uniform distance from one another in the region of the diametral widening, so that the annular cavity is subdivided into as many sections.

Preferably, these means for dividing the cavity are formed by vertically arranged metal sheets and/or plates which, in any event, are dimensioned in such a way that, in each case, such a means passes at least completely through the vertical cross section of the cavity.

According to a further advantageous embodiment, in addition to the means for dividing the cavity, further means for dividing the annular space into portions separated from one another are arranged in the annular space, gas being capable of being supplied from outside the shaft furnace, in each case independently, to each of the portions separated from one another.

The division of the annular cavity into sections separated from one another, together with the division of the annular space into portions separated from one another, proves advantageous, because it avoids or reduces the risk that, in the case of temporary faults in the passage of gas through the charge, the reduction gas will follow the path of least resistance and, as a result, reduction gas will flow through part-regions of the charge to an increased extent and other part-regions will be "under-supplied" with reduction gas.

Preferably, in this case, the means for dividing the annular space and the means for dividing the cavity are arranged in such a way that, in each case, a portion of the annular space is assigned to a number of sections of the cavity, with the result that gas can be supplied via the respective portion to the section or sections corresponding to it.

It is particularly preferred, in this case, that the number of means for dividing the annular space be equal to the number of means for dividing the cavity and that a portion be assigned in each case to one section.

Subdividing the annular space and the cavity by suitable means, for example refractory material, metal sheets, etc., gives rise to closed-off regions which can be subjected to gas quantities individually and in a controlled way. For example, it is possible, despite locally varying charge permeability, to introduce the same gas quantity into each region of the charge. It is, however, also possible, if the conduct of the process so requires, to introduce different gas quantities per region into the charge deliberately.

According to a further advantageous embodiment of the shaft furnace according to the invention, the vertical cross section of each portion of the annular space is designed to taper in the circumferential direction from the location of gas supply to the respective portion ends.

The result of this is that the velocity of the dust-laden gas from the location of gas supply as far as the respective portion end does not decrease or does not decrease as greatly as would be the case if the cross section of the annular space were constant in a circumferential direction. The gas velocity therefore remains sufficiently high at all the locations of the annular space, in order to avoid dust deposits in the annular space.

According to a further advantageous embodiment, to a number of gas supply ducts is assigned in each case a cleaning device which is capable of being operated from outside the shaft furnace and by means of which caked-on accumulations can be cleaned off from the gas supply ducts or from the annular space which precedes the gas supply ducts in the gas flow direction.

Process faults may also lead to deposits/caked-on accumulations in the annular space or the gas supply ducts. These deposits can be cleaned off by means of the cleaning device or cleaning devices. It is particularly advantageous that the cavity formed by the diametral widening affords a sufficiently large volume for receiving the released material, whereas, otherwise, this would lead merely to clogging of the gas supply ducts. Complicated shaft emptying or the outward extraction of the material is thus avoided.

In the simplest instance, in each case one cleaning device is expediently designed as a poker device, the poker device passing through the outer wall of the annular space essentially in each case in the extension of a respective gas supply duct.

According to a preferred embodiment, the diametral widening forms a frustoconical generated surface, the generatrix of which encloses with the horizontal an angle which is smaller than the angle of repose of the material located in the shaft furnace.

This results in the formation of an annular cavity which is delimited by the frustoconical generated surface, by part of the vertical inner wall of the shaft furnace and by the charge and in which the gas supplied through the gas-inlet orifices can be distributed uniformly. The term "angle of repose" is intended, in this case, to refer to the natural angle of repose which the generatrix of the generated surface of a charging cone forms with the horizontal.

Preferably, the angle which the generatrix of the generated surface encloses with the horizontal is 0 to 25°, whereby the diametral widening widens from the top downwards. The angle of repose of particulate sponge iron, ore pellets or particulate ore is about 35 to 40°. The difference between these two angles is therefore sufficiently large to give rise to an annular space, in which the reduction gas can be distributed optimally.

Particularly preferably, the angle which the generatrix of the generated surface encloses with the horizontal is 0°. In this design, the distance between the charge and the generated surface or the gas-inlet orifices arranged in the generated surface is such that the risk that dust-like or particulate material from the charge may pass into one of the gas supply ducts is minimized.

The gas supply system also has outstanding mechanical stability, since the dimensions of the gas supply ducts which pass through the wall of the shaft furnace can be kept so small that the gas-inlet orifices or the gas supply system formed by the gas supply ducts and by the refractory material surrounding the gas supply ducts can withstand the effective lateral forces arising from the charge.

The gas supply system is also capable of being produced in a simple way from conventional refractory material, for example fireclay bricks, since each part of the gas supply system is supported by parts located below it. No arrangements, such as, for example, an annular skirt, are provided, which would be connected to the wall of the shaft furnace solely via an upper edge.

As a result of an advantageous refinement, the gas supply ducts have an essentially rectangular cross section and are designed to taper from the bottom upwards, the inner edges of the gas supply ducts being rounded. This ensures that gas supply ducts, in which a build-up of material occurs in spite of the material-free annular cavity formed inside the shaft furnace, are cleaned again automatically, that is to say by means of the downward movement of the material in the shaft furnace.

According to a further advantageous refinement, the transition between the annular space, which externally surrounds the shaft furnace annularly, and the gas supply ducts is designed to descend obliquely downwards. Consequently, dust-like material from the reduction gas cannot accumulate in the annular space and, also, material which comes from the charge and which passes into the annular space due to process-induced faults cannot remain there. Instead, due to gravity, such material is returned to the shaft furnace again through the gas-inlet orifices which widen downwards.

BRIEF DESCRIPTION OF THE DRAWINGS

The shaft furnace according to the invention is explained in more detail below by means of FIG. 1 to FIG. 5 of the drawings in which.

DETAILED DESCRIPTION OF THE DRAWINGS

Figure 1:
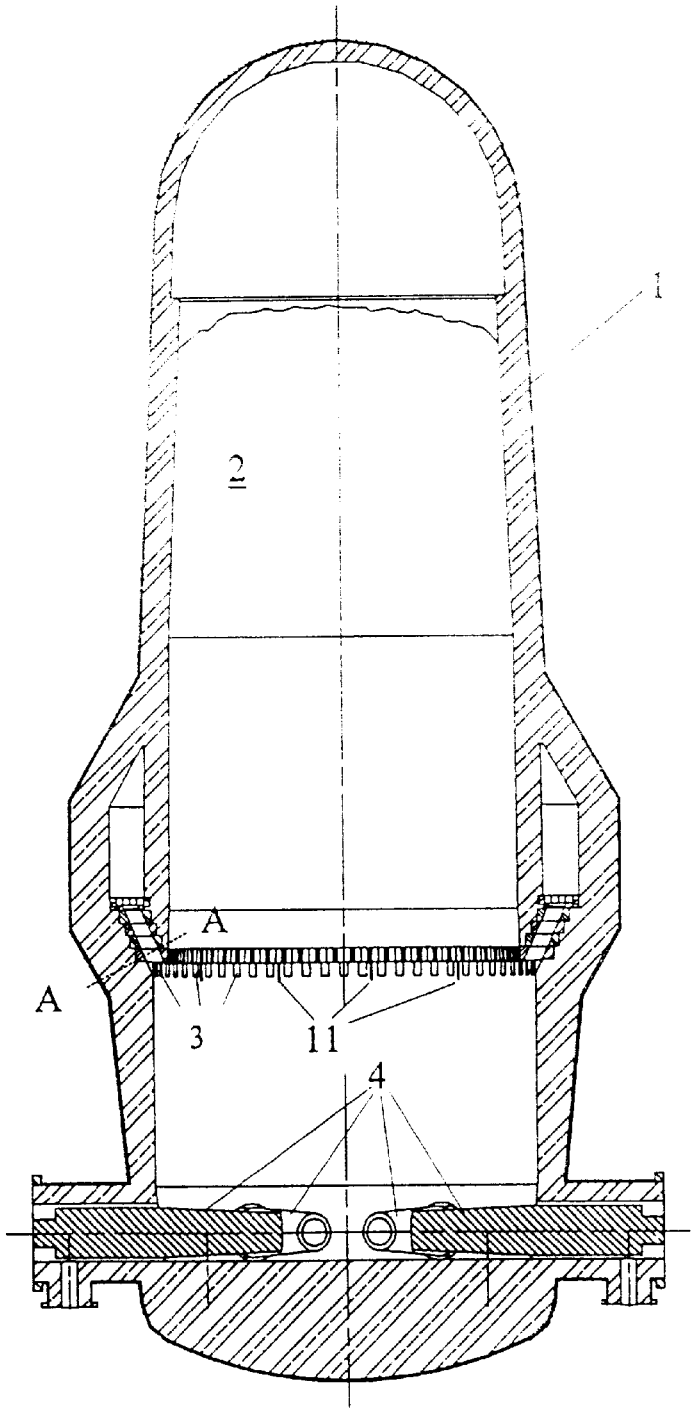
FIG. 1 shows an overall illustration of the shaft furnace

FIG. 1 shows the shaft furnace 1 according to the invention with a charge composed of particulate material 2 which is capable of being fed to the shaft furnace 1 from above (the feed device is not shown) . A multiplicity of gas-inlet orifices 3 are arranged in one plane in the region of the lower third of the shaft furnace 1. A reduction gas is injected into the charge 2 through these gas-inlet orifices 3. Screw conveyers 4, by means of which the particulate material is discharged from the shaft furnace 1, are arranged above the bottom of the said shaft furnace 1.

Figure 2:
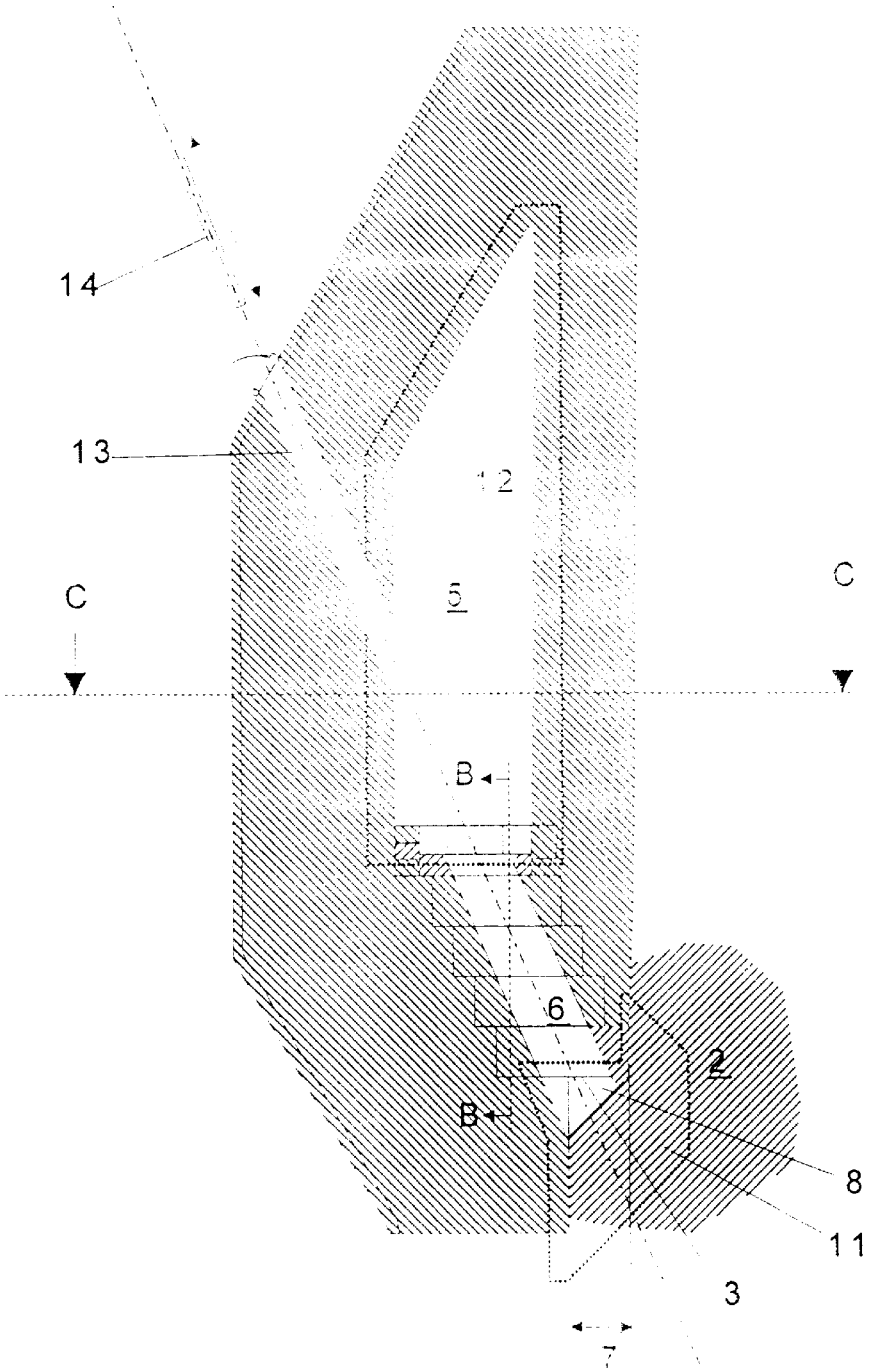
FIG. 2 shows the diametral widening of the shaft furnace with a gas supply duct and an annular space

FIG. 2 illustrates one of the gas-inlet orifices 3, with the annular space 5 surrounding the shaft furnace 1 externally and with one of the gas supply ducts 6 which connect the gas-inlet orifices to the annular space 5. The diametral widening 7 of the shaft contour is designed as a horizontal setback in the casing of the shaft furnace 1, so that an annular cavity 8 is formed between the gas-inlet orifices 3 and the charge 2. The reduction gas supplied through the gas supply ducts 6 and the gas-inlet orifices 3 can be distributed optimally in this cavity 8. FIG. 2 also illustrates by broken lines a means 11 for dividing the cavity and means 12 for dividing the annular space 5, the said means in each case being designed here as a vertically arranged metal sheet. A cleaning orifice 13 passes through the outer casing of the annular space 5, in such a way that the central axis of the cleaning orifice 13 coincides with the central axis of the gas supply duct 6. The cleaning orifices 13 is designed to be sealingly closeable externally. When necessary, deposits can be cleaned off from the gas supply duct 6 and part of the annular space 5, for example by means of a rod 14 (straight or bent).

Figure 3:
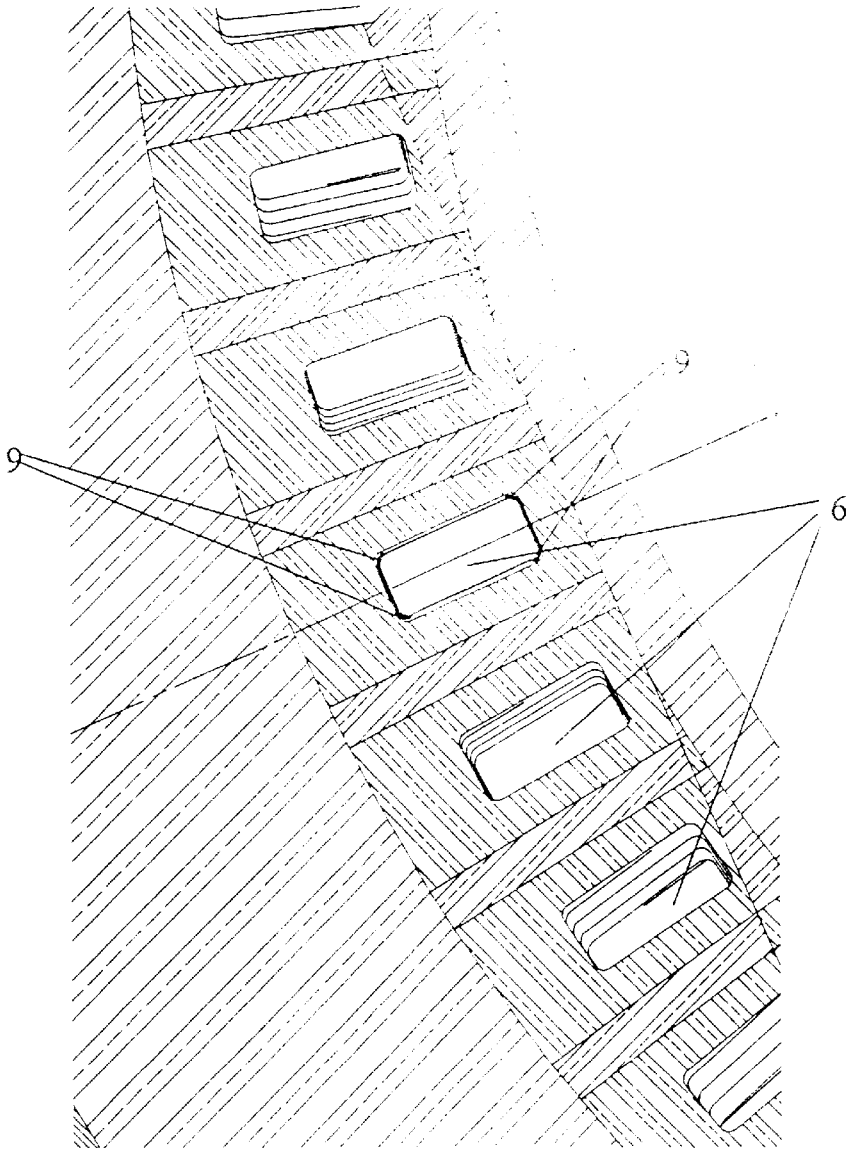
FIG. 3 shows the section A—A from FIG. 1

FIG. 3 illustrates a section through A—A of FIG. 1, the viewing direction vertically from below in the direction of one of the gas supply ducts 6 being selected. The inner edges 9 of the gas supply ducts 6 are rounded and the gas supply ducts 6 are designed to taper upwards. This ensures that dust-like material from the reduction gas does not settle in the gas supply ducts 6 or that, in the event of a build-up of material, the gas supply ducts 6 are automatically cleaned again in the course of the downward movement of the particulate material.

Figure 4:
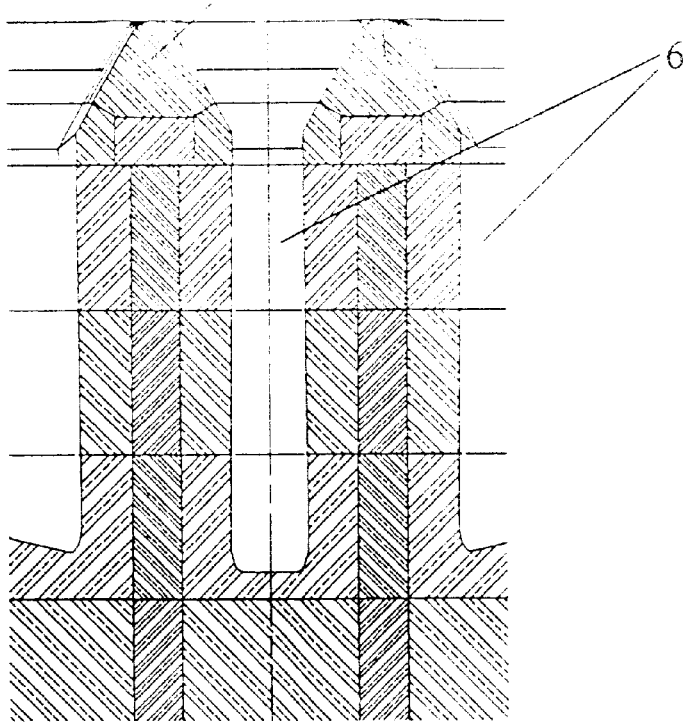
FIG. 4 shows the section B—B from FIG. 2

FIG. 4 shows a section through B—B of FIG. 2, as seen from inside the shaft. The gas supply ducts 6 widen from the top downwards and the transitions 10 from the annular space 5 to the gas supply ducts 6 are designed to descend obliquely downwards. This, too, is intended to ensure that dust-like material from the reduction gas does not settle in the annular space 5, but is introduced, together with the reduction gas, into the shaft furnace 1.

Figure 5:
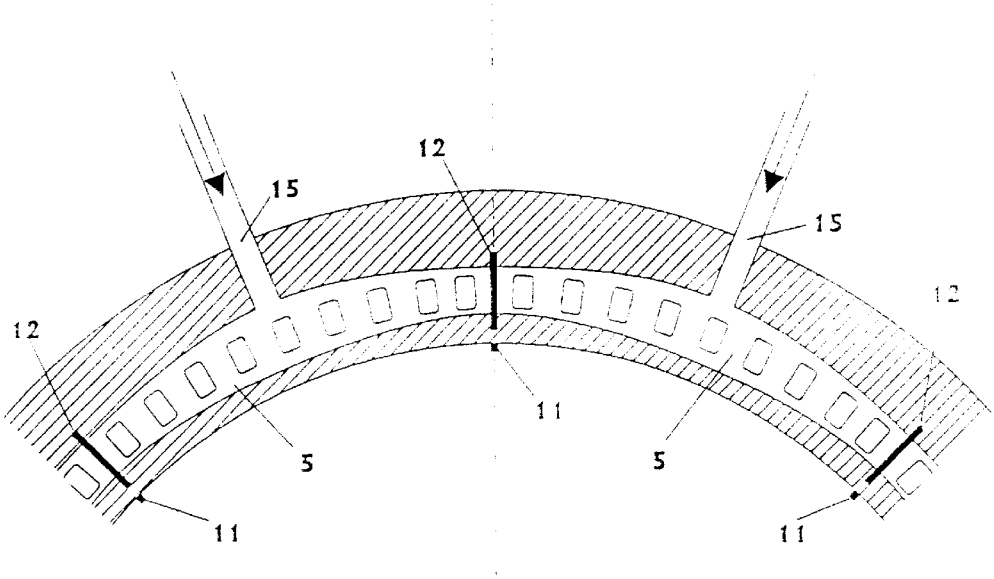
FIG. 5 shows the section C—C from FIG. 2.

FIG. 5 shows a section through C—C of FIG. 2, the annular space 5 being illustrated with a cross section which decreases in the circumferential direction from the location of gas supply 15 to the portion ends 12.

The invention is not restricted to the exemplary embodiment illustrated in FIG. 1 to FIG. 5 of the drawings, but also comprises all means which are known to the person skilled in the art and which may be employed in order to implement the invention.

For example, the metal sheets or plates are not restricted to the shape and size illustrated in FIG. 2, but may, depending on material-related and process-related requirements, also have, for example, rectangular contours or contours similar to a segment of a circle and also smaller dimensions, so that they do not project into the charge as far as is illustrated in FIG. 2.

As illustrated in the exemplary embodiments, the annular space may be connected structurally to the shaft, but it is also possible for the annular space to be formed by a ring pipeline which concentrically surrounds the shaft at a distance from the latter. The connection between the ring pipeline and the gas supply ducts is then made via widening spur conduits inclined downwards. This affords further advantages in the design of the reduction shaft, in particular in the refractory design, and improved accessibility of the annular space for cleaning purposes.

It is also possible for the reduction in cross section of the portions of the annular space not to be designed merely as a reduction in the horizontal diameter, as illustrated in FIG. 5, but, alternatively or additionally, as a reduction in the vertical diameter of the annular space or, in the case of a ring pipeline, as a conical constriction.

What is claimed is:

1. A shaft furnace for direct reduction of a charge comprised of a material of at least one of particulate iron and sponge iron, the charge having a characteristic angle of repose when loaded in the shaft furnace, the furnace comprising:

a substantially cylindrical body having an upper end into which the charge is fed, an interior in which the reduction takes place, and a bottom end at which the charge is withdrawn after reduction;

a plurality of gas inlet orifices disposed around the furnace body, the gas inlet orifices being located below the upper end of the furnace body and above the bottom end thereof and communicating with the interior of the body to permit delivery of a reducing gas thereto;

an annular space around the furnace to which the gas may be supplied, the annular space being connected to the gas inlet orifices by respective gas supply ducts;

the interior of the furnace body including a region thereof below the gas inlet orifices, that is widened diametrally, the widened region being so shaped that it forms an annular cavity surrounding the gas inlet orifices which is substantially free of charge when the furnace is in operation, the diametral widening being in the shape of a frustoconical surface having a generatrix which forms an angle with the horizontal which is smaller than the angle of repose of the charge material.

2. The shaft furnace according to claim 1, further comprising a plurality of dividers arranged around the interior of the furnace body in the region of the widening, the dividers extending for dividing the cavity into sections separated from one another.

3. The shaft furnace according to claim 2, comprising between 2 and 16 dividers arranged around the cavity at a uniform distance from one another.

4. The shaft furnace according to claim 2, wherein the dividers are vertically arranged metal sheets or plates.

5. The shaft furnace according to claim 1, wherein annular space surrounds the interior and is spaced upward from the orifices, the annular space being traversed by gas, a plurality of partitions dividing the annular space into portions separated from one another, an inlet to each of the portions of the annular space for receiving the gas independently of the other portions.

6. The shaft furnace according to claim 5, wherein the dividers and the partitions are placed so that each of the portions of the annular space communicates with a plurality of the sections of the cavity.

7. The shaft furnace according to claim 5, wherein there are as many of the partitions dividing the annular space as there are dividers dividing the cavity, so that each portion of the annular space communicates with a respective section of the cavity.

8. The shaft furnace according to claim 5, wherein each portion of the annular space has a cross section that tapers in a circumferential direction from a location of the respective gas inlet to the annular space portion to at least one of the ends of the portion spaced circumferentially from the respective gas inlet.

9. The shaft furnace according to claim 5, further comprising a respective cleaning device operable from outside the shaft furnace and extending to at least some of the gas supply ducts and being operable for cleaning off caked-on accumulations from the gas supply ducts or from the annular space.

10. The shaft furnace according to claim 9, wherein the cleaning devices are poker devices extendable into a respective gas supply duct.

11. The shaft furnace according to claim 1, wherein the diametral widening widens downward and the angle formed between the generatrix of the inner frustoconical surface and the horizontal ranges from 0° to 25°.

12. The shaft furnace according to claim 1, wherein the diametral widening widens downward and the angle formed between the generatrix of the inner frustoconical surface and the horizontal is 0°.

13. The shaft furnace according to claim 5, wherein the gas supply ducts have a rectangular cross section, and the gas supply ducts taper upwardly from the cavity to the annular space and have inner rounded edges.

14. The shaft furnace according to claim 12, wherein the annular space has a bottom provided with transitional regions, each of the transitional regions having a respective surface extending obliquely downwards from the bottom of the annular space to a respective gas duct.

* * * * *